United States Patent [19]

Paulus

[11] 4,417,720

[45] Nov. 29, 1983

[54] CONTINUOUS HEAT TREATMENT PLANT FOR STEEL SHEET

[75] Inventor: Philippe Paulus, Liege, Belgium

[73] Assignee: Centre de Recherches Metallurgiques, Brussels, Belgium

[21] Appl. No.: 213,196

[22] Filed: Dec. 4, 1980

[30] Foreign Application Priority Data

Dec. 12, 1979 [BE] Belgium ..... 880587
Jul. 1, 1980 [LU] Luxembourg ..... 82575

[51] Int. Cl.[3] ..... C21D 9/56
[52] U.S. Cl. ..... 266/112; 266/113
[58] Field of Search ..... 266/113, 112, 111; 148/156, 153

[56] References Cited

U.S. PATENT DOCUMENTS 3,358,980 12/1967 Taylor ..... 148/153
4,052,234 10/1977 Yamagishi et al. ..... 148/156
4,191,600 3/1980 Paulus et al. ..... 148/142

FOREIGN PATENT DOCUMENTS 835666 3/1976 Belgium .
1514270 11/1975 United Kingdom .
1497502 1/1976 United Kingdom .
1516611 1/1977 United Kingdom .
1571150 11/1977 United Kingdom .
1568483 2/1978 United Kingdom .

*Primary Examiner*—R. Dean
*Attorney, Agent, or Firm*—Holman & Stern

[57] ABSTRACT

The continuous steel-sheet heat-treatment plant comprises, in sequence, a zone in which the sheet is heated to a temperature above the recrystallization temperature, a zone in which the sheet is held at this temperature for more than 30 seconds, a rapid cooling zone, an optional overaging zone, and a final cooling zone. The rapid cooling zone has devices for spraying a cooling fluid and a tank containing an aqueous bath at above 75° C.

15 Claims, 2 Drawing Figures

CONTINUOUS HEAT TREATMENT PLANT FOR STEEL SHEET

FIELD OF THE INVENTION

The present invention relates to a continuous heat treatment plant for sheet steel, in order to produce in particular steel sheet for drawing or high strength steel sheet.

BACKGROUND OF THE INVENTION

The applicants have already advocated a method for the continuous heat treatment of thin steel sheet comprising a rapid cooling stage consisting of immersion in an aqueous bath at a temperature higher than 75° C., followed by an overaging stage (e.g. British patent specification No. 1,497,502). This method is advantageous in that it ensures good homogeneity of the properties of the steel and enables the manufacture of sheet for drawing and medium strength sheet. In addition, the heat energy contained in the sheet is converted into steam energy during the immersion of the sheet in the cooling bath, which steam may be readily recycled or the latent heat of the steam may be recovered.

British patent specification No. 1,514,270 and corresponding Belgian Patent Specification No. 835,866 proposes a further rapid cooling method which enables the production of the same grades of steel, but without the possible recovery of energy and without the possibility of discontinuing the rapid cooling at the overaging temperature. However, this method enables the production of steel having a very high strength by very rapid cooling to ambient temperature, this method being of a very low cost in terms of alloying elements.

SUMMARY OF THE INVENTION

The present invention relates in particular to a heat treatment plant enabling the production of all the grades of steel mentioned above, i.e. steel for drawing, and steel having medium and very high strength, by the economic use of energy, either by using recovery methods or by reducing the cost of re-heating.

The invention provides a plant which comprises:

- a zone for heating to a temperature higher than the recrystallisation temperature,
- a zone for holding at this temperature for a duration greater than 30 seconds, and
- a rapid cooling zone, and the rapid cooling zone comprises, on one hand, devices which enable a cooling fluid to be sprayed on the surface of the sheet and, on the other hand, a tank which may contain an aqueous bath at a temperature higher than 75° C.

The rapid cooling zone may be followed by an overaging zone, itself followed by a final cooling zone.

According to a particularly advantageously embodiment of the invention, the devices used to spray the cooling fluid are arranged so as to spray a liquid such as water or an aqueous fluid, which may be at ambient temperature, or which may be hot, boiling, or superheated. In particular, the devices may be atomizers enabling the cooling fluid to be atomised.

According to a further embodiment of the invention, the devices used for spraying the cooling fluid are designed for blasting of a gaseous agent, such as—preferably—a non-oxidising gas or an inert gas (e.g. nitrogen), which is preferably reducing ($H_2$ based). In a preferred variant of the invention, the devices are also provided with means for atomising, by means of the said gaseous agent, a liquid such as water in order to produce a cooling mist.

The said devices may be disposed in such a way that the sprayed cooling fluid is, after possible condensation, recovered in the tank containing the aqueous bath at a temperature higher than 75° C.

Also the plant preferably comprises means for recovering the gaseous atomization agent, for purifying it, for recompressing it, and for re-introducing it into the atomizers.

According to an embodiment of the invention, the rapid cooling zone comprises means enabling the level of the water in the tank to be varied and means enabling the rolls around which the sheet turns to be displaced, which thus enable the length of travel of the sheet in the aqueous bath at a temperature higher than 75° C. to be modified and/or enable the action of the spraying devices to be modified, in such a way as to modify the temperature of the strip at the output of this zone.

According to a further embodiment of the invention, the rapid cooling zone is preceded by a slow cooling zone, for example slow cooling provided by blasting of atmospheric gas.

The final cooling zone preferably comprises three successive units: the first unit comprises means for blasting atmospheric gas which may cool the sheet to a temperature lower than 350° C., the second unit comprises means for immersing the sheet in an aqueous bath at a temperature higher than 75° C., this bath having a composition which is suitable for surface treatment of the steel, and the third unit comprises means for cooling the sheet in cold water, this water being used preferably as rinsing water.

The composition of the bath designed to treat the surface of the steel fulfils the following requirements in the case of pickling: solution of at least one organic acid whose pH is maintained between a minimum value of 1.5 and a maximum value of 4, and whose temperature is maintained above a minimum value $T_m$(°C.) given by the formula: $T_m = 20 + (pH - 1.5) \times 32$, wherein pH is the value at which the pH of the pickling solution is maintained, the solution also comprising iron in a quantity greater than 50 mg per liter.

According to a further embodiment of the invention, the plant comprises a naked-flame furnace, with non-oxidising flames, preferably vertical, designed to heat all or part of the sheet to be treated.

According to a further embodiment of the invention, the plant comprises means for recovering the energy contained in the steam produced by the vaporization of the cooling fluid sprayed by the said devices and/or during the immersion of the sheet in the aqueous bath at a temperature higher than 75° C. both in the rapid cooling zone and possibly in the final cooling zone.

DESCRIPTION OF PREFERRED EMBODIMENT

Figure 1:
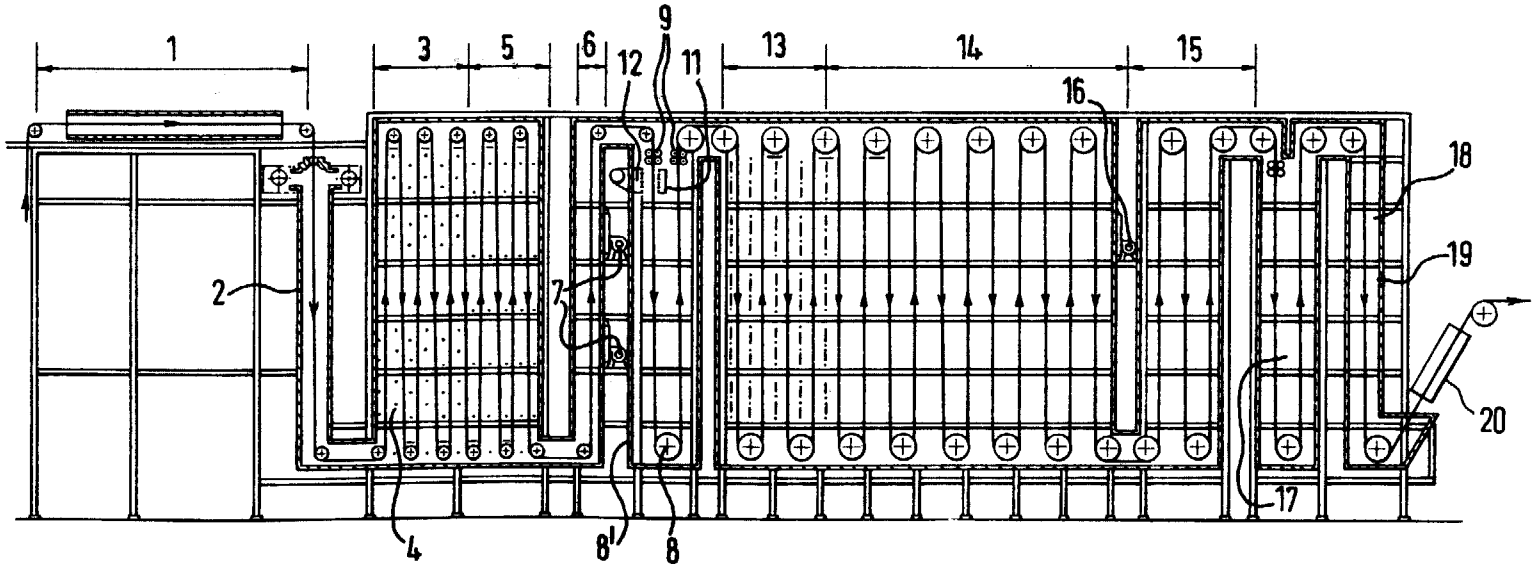
FIG. 1 is a side view of a heat treatment plant for steel sheet.
Figure 2:
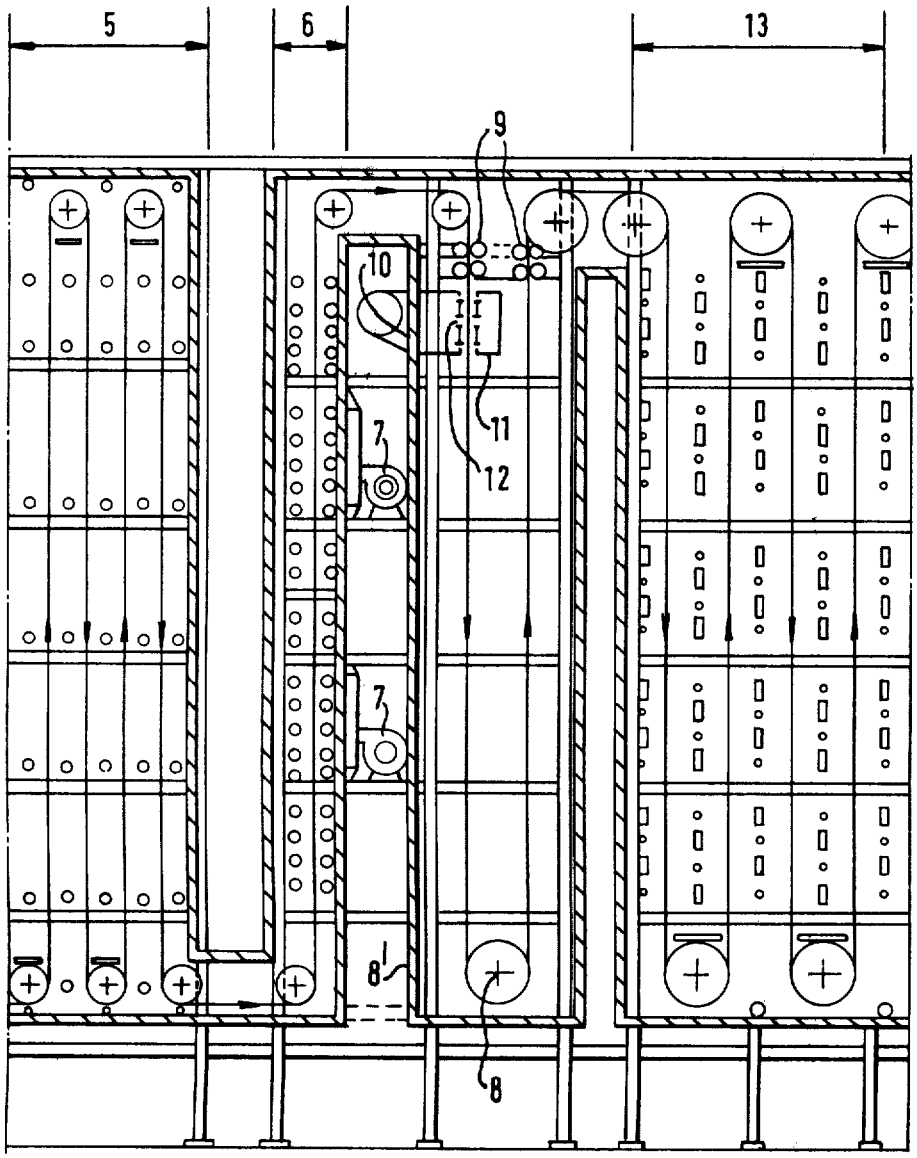
FIG. 2 is a detail of FIG. 1 on an enlarged scale.

FIG. 1 shows a plant which is complete from the input of the sheet into the re-heating ovens to its output at the final drying oven. The input stations (unwinding, seaming, degreasing, piling) and output stations (piling, skin-pass, flattening, inspection, shearing, coiling, stacking) which are well-known have not been shown, in order to simplify the drawing. FIG. 2 shows the apparatus of the rapid cooling zone.

Cold-rolled sheet is introduced into a recovery zone 1 comprising an oven which is supplied with the vapor from heating ovens 2 and 3.

On discharge from zone 1, the sheet has a temperature in the range of 200° to 250° C. and is introduced into the heating oven 2, which is vertical naked-flame furnace having a non-oxidising atmosphere. This oven heats the sheet to approximately 600° C.

From the oven 2, the sheet passes into the heating oven 3, having radiant tubes 4, in which the sheet is heated to 600° C. to 700° C. or more, according to the steel grade. The radiant tubes 4 are supplied by means of natural gas.

The sheet then passes into a holding zone 5 in which it is maintained at the temperature achieved at the end of heating in oven 3.

After this temperature holding operation, the sheet is introduced into a slow cooling zone 6. Slow cooling is carried out by jets of atmospheric gas. These jets are produced by fans 7 and the gas is recycled continuously by means of a closed circuit.

On discharge from the zone 6, the sheet is introduced into apparatus 10 which is characteristic of the rapid cooling zone. This apparatus comprises in particular a tank 8' of a great height containing boiling water. The level of the return roller 8 located at the base of this tank may be varied in order to modify the length of the travel of the sheet in the cooling bath. This apparatus also comprises cooling banks 11 constituted by casings provided with spray devices 12 disposed symmetrically on either side of the sheet. These devices spray a cooling fluid, preferably finely atomised, onto the sheet. (see for example, British patent specification Nos. 1,516,611, 1,568,483, and 1,571,150). Lock chambers 9 are disposed at the input and output of this apparatus 10 in order to prevent the vapor produced in this apparatus from escaping into the adjacent ovens.

At the output of this apparatus 10 there is located an overaging furnace 13 in which the sheet is re-heated to 450° C. The sheet then passes into an oven 14 in which it is maintained at the overaging temperature.

The sheet then passes through a three-stage cooling zone in which the cooling stages are:

- firstly cooling by jets of gas in a zone 15 provided with fans 16;
- secondly cooling by immersion in a tank 17 containing a boiling water bath maintained at a temperature of 100° C. and containing formic acid (2 g/l);
- thirdly cooling in a rinsing tank 18, in which an aqueous fluid is sprayed onto the sheet by means of second spray devices 19.

The sheet is discharged from the tank 18 and passes into a drying bank 20 before passing through the output stations (skin-pass, inspection, shearing, cooling) which are not shown for the reasons mentioned above.

FIG. 2 shows the rapid cooling apparatus 10 in greater detail, this apparatus comprising:

- a tank 8' of a great height containing boiling water and a return roller 8 around which the sheet passes;
- cooling banks 11 with the spraying devices 12 supplied via a casing;
- input and output lock chambers 9.

The following examples of use are also given by way of non-limiting example.

EXAMPLE 1

A sheet of rimming steel of commercial grade having the following composition was treated: C=0.08%, Mn=0.3%, P=0.015%, S=0.018%. Its thickness was 0.8 mm.

During passage through the plant described above, the sheet was brought successively to the following temperatures:

- on discharge from zone 1: 240° C.
- on discharge from zone 2: 580° C.
- on discharge from zone 3: 705° C.
- on discharge from zone 5: 705° C., hold for 40 seconds.

Cooling in zone 6 was carried out at idling speed so as to economize on electrical energy. However, this idling was such that it enabled the heating of the fans to be avoided. On input into the apparatus 10, the sheet was at 680° C. and the action of the devices 12 and the position of the return roller 8 in the tank 8' containing boiling water were adjusted so as to obtain a sheet temperature of 400° C. when the sheet was discharged from the tank.

On discharge from the overaging oven 14, the sheet was at 450° C., and was then cooled slowly from 450° to 425° C. for 45 seconds.

The sheet then passed through the cooling zone having three stages 15, 17, 18 under the following conditions:

- in zone 15, the sheet was cooled by jets of gas from 425° C. to 300° C.,
- in zone 17, the sheet was quenched in a 2 g/l solution of formic acid at 100° C., from which it was discharged at 100° C.,
- in zone 18, the sheet was rinsed with filtered water at 30° C.

The sheet was finally passed through the drying bank 20, from which it was discharged at a temperature of 40° C.

The mechanical properties of the sheet treated in this way were as follows:

elastic limit (E): 230 MPa
tensile strength (R): 340 MPa
elongation (A): 40%
Erichsen test: 11 mm.

During the passage of the sheet, the vapor produced in the tank 8' by the rapid cooling and in the tank 17 by the final cooling, was recovered and served to heat the water of a boiler supplying an electrical turbine. It was possible in this way to recover $72.10^6$ J per tonne of sheet, with a minimum energy expenditure in the blast cooling zone. The re-heating (overaging) furnace 13 only used $30.10^6$ J per tonne of sheet.

EXAMPLE 2

A high strength steel of economic quality was treated. This was killed steel having the following composition: C=0.06%, Mn=0.8%, Si=0.15%, Al=0.04%, S=0.015%, P=0.02%. This sheet had a thickness of 0.8 mm.

The temperatures of the sheet on output from zones 1,2,3, and 5 were as follows:

zone 1: 250° C.
zone 2: 640° C.
zone 3: 800° C.
zone 4: 800° C., hold for 40 seconds.

The cooling zone 6 was adjusted in such a way that the sheet entered the apparatus 10 at 740° C. In this way, the steel contained 15% of austenite on input into the cooling zone. The tank 8' was empty and the devices 12 sprayed a mist of finely atomised water onto the sheet, whose temperature was abruptly decreased to 300° C. in one second.

The furnace 13 was not heated and in the zone 14 the temperature of the sheet was reduced to 250° C.

In respect of the final cooling, the sheet was subjected to the following conditions:

in zone 15, the temperature was reduced to 150° C. by jets of gas;

in zone 17, the sheet was immersed in a 2 g/l solution of formic acid at 100° C., in zone 18, the sheet was rinsed by a spray of filtered water at 30° C.

The sheet was finally passed through the drying bank 20, from which it was discharged with a temperature of 40° C.

The mechanical properties of the sheet treated in this way were as follows:

elastic limit (E): 320 MPa tensile strength (R): 510 MPa elongation (A): 29%

Erichsen test: 9.8 mm.

The method of carrying out the continuous heat treatment of steel sheet by means of the plant described above is essentially characterised in that:

the sheet is heated to a temperature greater than the recrystallisation temperature of the steel;

the sheet is held at this temperature for a duration of more than 30 seconds;

the sheet is subjected to a rapid cooling operation comprising a stage in which a cooling fluid is sprayed onto the surface of the sheet, followed by a stage in which the sheet is immersed in an aqueous bath at a temperature greater than 75° C.;

the sheet is possibly subjected to an overaging operation for a duration of more than 20 seconds;

the sheet is subjected to final cooling.

According to an advantageous embodiment of the invention:

the sheet is heated to a temperature greater than the recrystallisation temperature;

the sheet is maintained at this temperature for a duration of more than 30 seconds;

the sheet is subjected to a rapid cooling operation in which boiling or superheated hot water is sprayed onto its surface;

the sheet is possibly subjected to an overaging operation, after the rapid cooling zone;

the sheet is subjected to final cooling.

According to a further advantageous embodiment of the invention:

the sheet is heated to a temperature greater than the recrystallisation temperature;

the sheet is maintained at this temperature for a duration greater than 30 seconds;

the sheet is subjected to a rapid cooling operation in which a cooling spray constituted by at least one gaseous agent and/or a mist obtained by atomization of a liquid by means of a gaseous agent is sprayed onto its surface;

the sheet is possibly subjected to an overaging operation after the rapid cooling operation;

the sheet is subjected to final cooling.

In accordance with a particularly advantageous variant of the present invention, the applicants have discovered an unexpected relationship existing between the quality of the sheet produced using the continuous heat treatment consisting of immersion in a bath of water brought to a temperature greater than 75° C. (and in particular the planarity of this sheet) and the position of the boundary at which the vapor film—or calefaction layer—disappears, which film is formed on the surface of the sheet at the beginning of the operation.

According to a variant, the conditions of the rapid cooling stage are modified by adjusting the temperature of the cooling fluid sprayed onto the sheet before immersion in the aqueous bath.

Various advantageous embodiments of this last variant are described as follows.

According to a first advantageous embodiment, a cooling fluid constituted by a water/steam mist is sprayed onto the sheet and the temperature of the mist is adjusted by modifying the temperature of one and/or the other of the constituents and preferably that of the water introduced into the mist forming device.

According to a second preferred embodiment, the cooling fluid sprayed onto the sheet is hot water, for example taken from the tank in which the sheet is immersed, and the temperature of this water is modified in an auxiliary plant disposed between the tank and the spray device.

In a particular use of the latter variant, the temperature of the water taken from the tank is modified by mixing it with cold water; in a further use, the hot water is passed through an adjustable heat exchanger.

A further very advantageous embodiment of this variant consists in adjusting the temperature of the sheet in the rapid cooling zone by spraying onto both sides of the sheets an aqueous mist produced by compressed steam atomizing a mixture of hot water, for example taken from the immersion tank for the sheet, and cold water, brought in from outside. The temperature of the water mixture is adapted to the cooling conditions required by the heat treatment method of the sheet, and in particular for positioning the calefaction layer in the descending portion of the path of the sheet through the bath.

In the case of this latter variant, the plant described above comprises, in addition to the components mentioned above, means for modifying the temperature of the cooling fluid sprayed onto the sheet. The following application is given by way of non-limiting example.

EXAMPLE 3

Steel sheet having a thickness of 0.5 mm and a width of 1 m was treated in a continuous manner by immersion in a bath of boiling water, the speed of passage through the bath being 180 m/minute.

Before immersion, the sheet was subjected to the action of injectors of the "mist" type, supplied with nitrogen (pressure: 0.3 MPa) and hot water (pressure: 0.09 MPa); on input into the spray jet cooling zone the temperature of the sheet was 700° C.

1. Cooling by spray jets supplied with water at 98° C. (taken from the immersion tank);

temperature of the sheet on input into the bath; 650° C.

temperature on discharge from the bath: 150° C.

planarity: unacceptable.

2. Cooling by spray jets supplied with water at 60° C. (mixture of water taken from the tank and cold water);

temperature of the sheet on input into the bath: 450° C.

discharge temperature: 150° C. (need for adjustment of the height of the bath);

planarity: excellent.

I claim:

1. A continuous heat treatment plant for steel sheet, comprising in sequence:

(a) means for heating the steel sheet to a temperature higher than the recrystallization temperature of the steel;

(b) means for holding the steel sheet at this temperature for more than 30 seconds; and (c) a rapid cooling zone comprising (i) means for spraying a cooling fluid onto the steel sheet, and (ii) a tank for containing an aqueous bath, means for maintaining the aqueous bath at a temperature greater than 75° C., (1) means for varying the level of the aqueous bath in the tank, and (2) a roller contained within the tank around which the steel sheet passes and means for displacing said roller—so that the length of the path of the sheet through the aqueous bath can be modified by employing either or both of (1) and (2).

2. The plant of claim 1, further comprising, after the rapid cooling zone, an overaging zone followed by a final cooling zone.

3. The plant of claim 1, in which the rapid cooling zone comprises means for modifying the action of the spraying means so as to adjust the temperature of the strip on discharge from this zone.

4. The plant of claim 1, in which the spraying means comprises means for spraying a liquid.

5. The plant of claim 1, in which the spraying means comprises atomizers.

6. The plant of claim 1, in which the spraying means comprises means for blasting a gaseous agent.

7. The plant of claim 6, in which the gaseous agent is a reducing agent.

8. The plant of claim 6, in which the blasting means comprise means for atomizing a liquid, by means of the gaseous agent.

9. The plant of claim 1, further comprising means for conducting the cooling fluid to the tank after it has been sprayed onto the sheet.

10. The plant of claim 6, further comprising means for recovering, purifying, and re-utilizing the gaseous agent.

11. The plant of claim 1, in which the rapid cooling zone is preceded by a slow cooling zone.

12. The plant of claim 1, further comprising a final cooling zone comprising three successive units: the first unit comprising means for blasting atmospheric gas in order to cool the sheet to a temperature lower than 350° C., the second unit comprising means for immersing the sheet in an aqueous bath at a temperature greater than 75° C., this bath having a composition designed to treat the surface of the steel, and the third unit comprising means for cooling the sheet in cold water.

13. The plant of claim 1, further comprising a non-oxidising naked-flame furnace arranged to heat the sheet to be treated.

14. The plant of claim 1, further comprising means for recovering the energy contained in vapor produced in the plant.

15. The plant of claim 1, further comprising means for modifying the temperature of the cooling fluid sprayed onto the sheet.

* * * * *